United States Patent [19]

Laapotti

[11] Patent Number: 4,586,984

[45] **Date of Patent: * May 6, 1986**

[54] PRESS SECTION FOR A FIBROUS WEB

[75] Inventor: Jorma Laapotti, Palokka, Finland

[73] Assignee: Valmet Oy, Finland

[ * ] Notice: The portion of the term of this patent subsequent to Nov. 5, 2002 has been disclaimed.

[21] Appl. No.: 591,786

[22] Filed: Mar. 21, 1984

[30] Foreign Application Priority Data

Mar. 25, 1983 [FI] Finland ..... 831028

[51] Int. Cl.[4] ..... D21F 3/04

[52] U.S. Cl. ..... 162/360.1; 162/205; 162/306; 162/359

[58] Field of Search ..... 162/360.1, 358, 359, 162/305, 306, 205, 206

[56] References Cited

U.S. PATENT DOCUMENTS

| | | | |
|---|---|---|---|
| Re. 30,268 | 5/1980 | Justus | 162/360.1 |
| 3,355,350 | 11/1967 | Reynolds | 162/358 |
| 3,861,997 | 1/1975 | Ely | 162/360.1 |
| 3,981,084 | 9/1976 | Sobota | 162/360.1 |
| 4,016,032 | 4/1977 | Kankaanpaa | 162/305 |
| 4,086,131 | 4/1978 | Rempel et al. | 162/360.1 |
| 4,163,688 | 2/1979 | Kankaanpaa | 162/359 |
| 4,192,711 | 3/1980 | Tapio et al. | 162/360.1 |
| 4,201,624 | 5/1980 | Mohr et al. | 162/305 |

FOREIGN PATENT DOCUMENTS

| | | | |
|---|---|---|---|
| 774213 | 5/1957 | United Kingdom | 162/360.1 |
| 2028886 | 3/1980 | United Kingdom | 162/360.1 |

*Primary Examiner*—S. Leon Bashore
*Assistant Examiner*—K. M. Hastings
*Attorney, Agent, or Firm*—Steinberg & Raskin

[57] ABSTRACT

A press section for a running fibrous web, and a method of pressing therein. The press section comprises a first press zone, means for passing the fibrous web in a closed draw to the first press zone, means for changing running direction of the web after the first press zone to substantially reverse the running direction thereof, a second press zone disposed after the means for changing the running direction of the web, and a central roll forming a part of the first and second press zones, with the first and second press zones being disposed substantially opposite one another about the central press roll and constituting means for compensating compression load and weight of the central press roll, and also comprising means for directing the web in a closed draw out of the press section after the second press zone. The method of the present invention comprises the steps of disposing first and second press zones substantially opposite one another about a central roll, pressing the running web in the first press zone, changing the running direction of the web after the first press zone, directing the web into the second press zone, pressing the web in this second press zone, and directing the running web in a closed draw away from the second press zone.

19 Claims, 2 Drawing Figures

PRESS SECTION FOR A FIBROUS WEB

BACKGROUND OF THE INVENTION

The present invention is directed to a press section for a fibrous web, such as a paper web, and to a method of applying pressure therein onto the fibrous web passing through such a press section.

More specifically, the present invention is directed to a press section having a close draw, such as for a paper machine or a cardboard machine, in which at least two press zones are formed, at least one of the press zones being a belt nip and/or a shoe nip, having a wide pressing region in the direction of the running of the fibrous web.

It is commonly known in the prior art to remove water out of fibrous webs, such as from paper or cardboard webs, by passing such a web through a press nip formed by two rolls disposed opposite one another. As known in the prior art, one or two press fabrics and passed through such dewatering nips, these press fabrics carrying water removed out of the fibrous web, and also acting to convey the fibrous web forwardly.

As the production rate of such paper machines increases, the dewatering performed by means of such nip pressing has become an obstacle limiting increase of speed of paper production. This is due to the fact that the press nip is formed by a pair of rolls having a short pressing area, so that the residence time of a running fibrous web in these nips is very short at very high speeds of operation. However, due to the flow resistance of the fibrous structure of the web itself, water requires a certain minimum amount of time for escaping out of the web into the hollow face of a press roll or into a press fabric, in a dewatering operation.

Several successive press nips have been used for dewatering as disclosed in the prior art, examples of which include the so-called compact "Sym-Press" press section, or several separate, individual, successive press nips. However, the use of successive press nips requires a relatively large area for operation, especially if separate, individual press nips are used one right after the other. Compact construction of press sections however, such as the "Sym-Press" press section, cause difficulty in obtaining optimal positioning of the various components, as well as creating difficulties in the operation of the press itself, such as in the removal of paper broke. In nip presses, suction rolls are commonly used which are relatively expensive components and which consume a tremendous amount of suction energy and cause noise. In suction rolls, a perforated mantle must be used, which causes problems with the mechanical strength of such suction rolls.

If an attempt is made to increase dewatering output in nip presses by increasing the nip pressure, a certain limiting line pressure value is reached, beyond which any increase in the line pressure is no longer helpful because the structure of the fibrous web and of the press fabrics can no longer withstand the increased compression pressure.

Attempts have been made to lengthen the area of roll nips contacted by the web to be dewatered, through the use of rolls of larger diameter and by using soft press fabric, but even with utilization of these features, a limit in terms of feasible economic application is soon reached.

In order to solve the problems noted above in addition to other problems, so-called long-nip presses have been developed in recent years. Embodiments of such presses are disclosed, for example, in U.S. Pat. Nos. 3,808,092; 3,808,096; 3,840,429; 3,970,515; 4,201,624; and 4,229,253, as well as in GP Pat. Appln. No. 2,057,027.

Another prior art press construction is disclosed in U.S. Pat. No. 3,783,097, assigned to Beloit Corporation, U.S.A.

In U.S. Pat. No. 3,783,097, a long-nip press is disclosed in which several subsequent pressure shoes are utilized, the pressure shoes being pressed towards an opposing belt and press roll.

In U.S. Pat. No. 3,840,429, a long-nip press is described in which the web to be pressed linearly runs between two felts through a press zone formed by two opposing press shoes, and generated by means of a pressure medium. Moreover, bands are disposed inside the loops of the felts, to define the press zones and transmit pressure of the medium to the web.

In the prior art roll presses, it has generally been necessary to use a press suction roll, which results in considerable drawbacks, to be discussed in more detal infra. The perforations of a press suction roll may leave markings on the web which impairs the appearance of the paper, and which may also affect the surface properties of the paper produced. Press suction rolls are costly, require a drive motor of their own with concomitant adjustment systems, and also cause a tremendous amount of noise. In particular, drilling and mounting of such press suction rolls is a difficult operation, and also results in high costs. The perforations of on the press suction roll reduces the strength of the mantle. It therefore is necessary to use special metal alloys as the construction material for the rolls, as well as constructing such rolls with mantles of large thicknesses, also resulting in high material costs.

Press suction rolls consume large amounts of air, because in addition to air passing through the web and the felt entering the suction system, ambient air also enters into the suction system through the holes in the mantle along the suction zone of the suction roll, during each revolution of the roll. Moreover, sealing water of the suction box in the suction roll causes many difficulties.

An operational drawback of the suction rolls is that they operate at high noise levels. Reduction of such noise in a press section is also an object of the present invention.

In particular, in the case of press suction rolls, it is often necessary to utilize variable crown equipment. However, this is usually not possible because the mantle of the suction roll is perforated and/or the interior of the suction roll is occupied by the suction box to such an extent, that conventional variable crown equipment cannot be fitted therein. As noted above, a suction roll, especially a press-suction roll, is an extremely expensive component, and may cost up to about 3,000,000 FIM, at present day values.

SUMMARY OF THE INVENTION

Accordingly, it is an object of the present invention to provide a new and improved press section for a fibrous web, and a new and improved method of pressing the fibrous web therein, in which the drawbacks noted above concerning the prior art are successfully avoided.

It is also an object of the present invention to provide a press section for a fibrous web, and method of pressing therein, in which a web of good symmetry is achieved, by removing water in two directions through the fibrous web, i.e. through both faces of the web.

It is also an object of the present invention to provide a press section for a fibrous web and method of pressing therein, in which the web is passed in a closed draw from a preceding wire section to a subsequent drying section, to also improve qualities of the running web.

It is a further object of the present invention to provide a press section for a fibrous web and a method of pressing therein, in which removal of water can be successfully enhanced and increased.

It is a still further object of the present invention to provide a press section for a fibrous web, and a method of pressing therein, in which removal of water from a web is enhanced by advantageous arrangement of long-nip presses constituted by belt and/or shoe nips.

It is still another object of the present invention to provide a press section for a fibrous web, and a method of pressing therein, in which dewatering of the web can be enhanced and increased, by provision of means for intensifying dewatering of the web in the long-nip presses. Such means for intensifying dewatering may be disposed between two such long-nip presses in the press section.

It is a further object of the present invention to provide a press section for a fibrous web, and a method of pressing therein, with pressing/dewatering of the running web occurring with maximum efficiency, so that the running web reaches a maximum drysolids content after the press section.

It is a still further object of the present invention to provide a press section for a fibrous web, and method of pressing therein, where energy efficiency of pressing-/dewatering is considerably greater than such energy efficiency of water removal taking place by evaporation, so that energy is conserved.

It is a further object of the present invention to provide a press section for a fibrous web, and method of pressing therein, in which compression loads resulting from nip pressure, in particular from nip pressure in a wide press region, can be successfully controlled and compensated for in an advantageous manner.

It is still another object of the present invention to provide a press section for a fibrous web, and method of pressing therein, in which the weight of a pressing component in such a press section can be utilized to enhance dewatering of the running web.

It is a further object of the present invention to provide a press section for a fibrous web, and method of pressing therein, in which generation of noise is held to a minimum.

It is a further object of the present invention to provide a press section for a fibrous web, and method of pressing therein, in which risk of breakage of the running web through the press section is reduced to a minimum.

These and other objects are attained by the present invention, which provides a press section for a fibrous web, comprising:

a first press zone disposed in the press section, means for passing the fibrous web in a closed draw to the first press zone, means for changing running direction of the web after the first press zone to substantially reverse the running direction thereof, a second press zone disposed after the means for changing the running direction of the web, a central roll forming a part of the first and second press zones, with the first and second press zones being disposed substantially opposite one another and constituting means for compensating compression load generated in the press zones and weight of the central roll, and means for directing the web in a closed draw out of the press section after the second press zone.

More particularly, the present invention comprises such a press section in which the means for changing the running direction of the web comprises a reversing suction roll with the web passing over a suction sector on this suction roll, the first press zone includes a roll nip, a plurality of individual nips, or a nip having a wide pressing region in the running direction of the web, the second press zone includes at least one of a belt nip or a shoe nip having a wide pressing region in the running direction of the web or a plurality of any such nips, and the means for directing the web out of the press section also constitutes means for directing the fibrous web into a subsequent drying section and onto a drying fabric.

The present invention also comprises a method of pressing a fibrous web such as a paper web in a press section, which comprises the steps of disposing first and second press zones substantially opposite one another about a central roll, passing the running web in a closed draw into the first press zone, pressing the web in the first press zone, changing the running direction of the web after the first press zone, directing the running web into the second press zone, pressing the web in the second press zone, and directing the running web in a closed draw away from the second press zone and out of the press section.

BRIEF DESCRIPTION OF THE DRAWINGS

The present invention will be described in detail with reference to exemplifying embodiments illustrated in the figures of the accompanying drawings, the present invention not being strictly confined to the specifics of the exemplary embodiments described herein. In the accompanying drawings

DETAILED DESCRIPTION OF THE PREFERRED EMBODIMENTS

Figure 1:
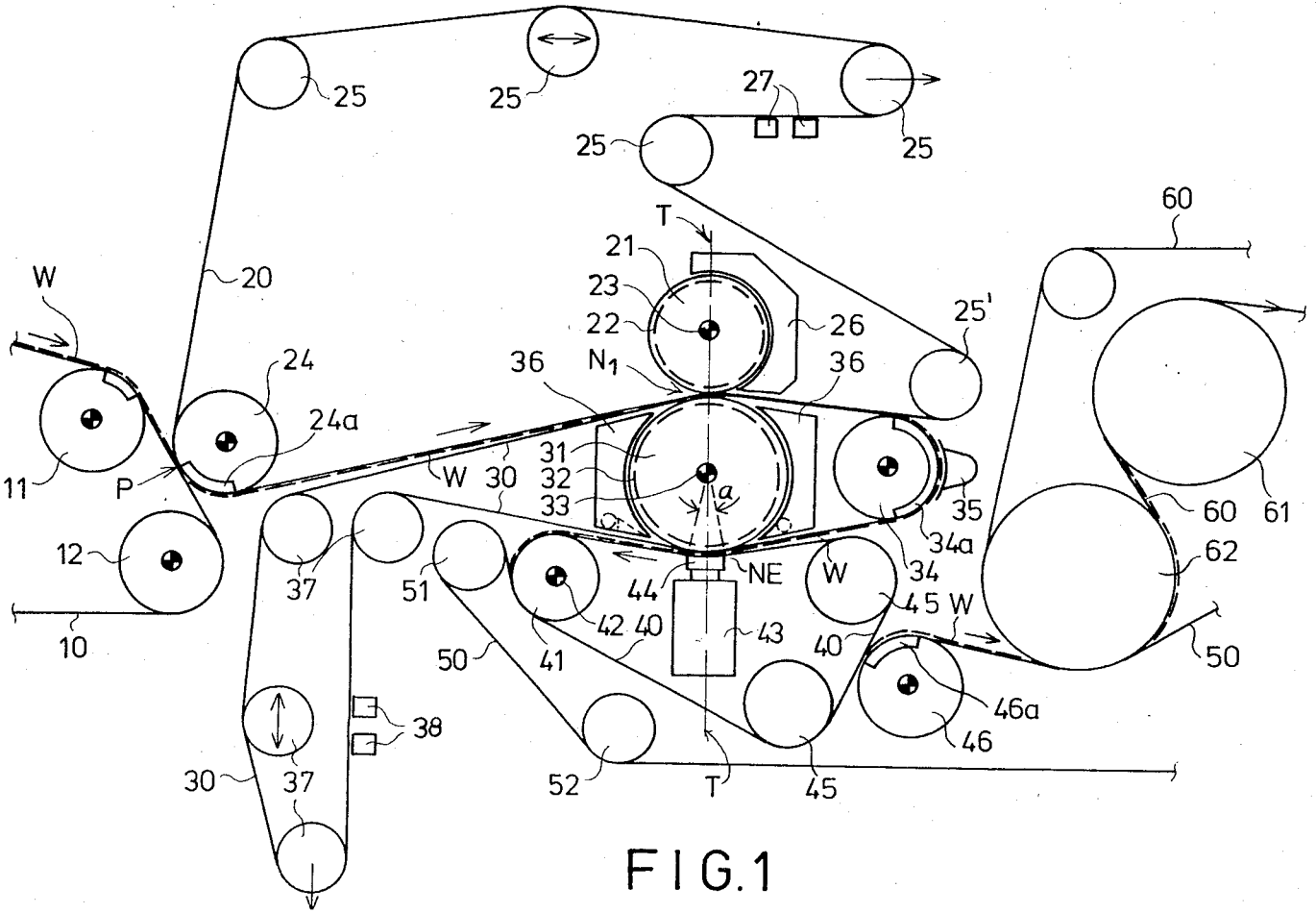
FIG. 1 is a schematic side view of a press section of the present invention, in which both a roll nip and a shoe nip having a wide press region in the running direction of the web, are utilized.
Figure 2:
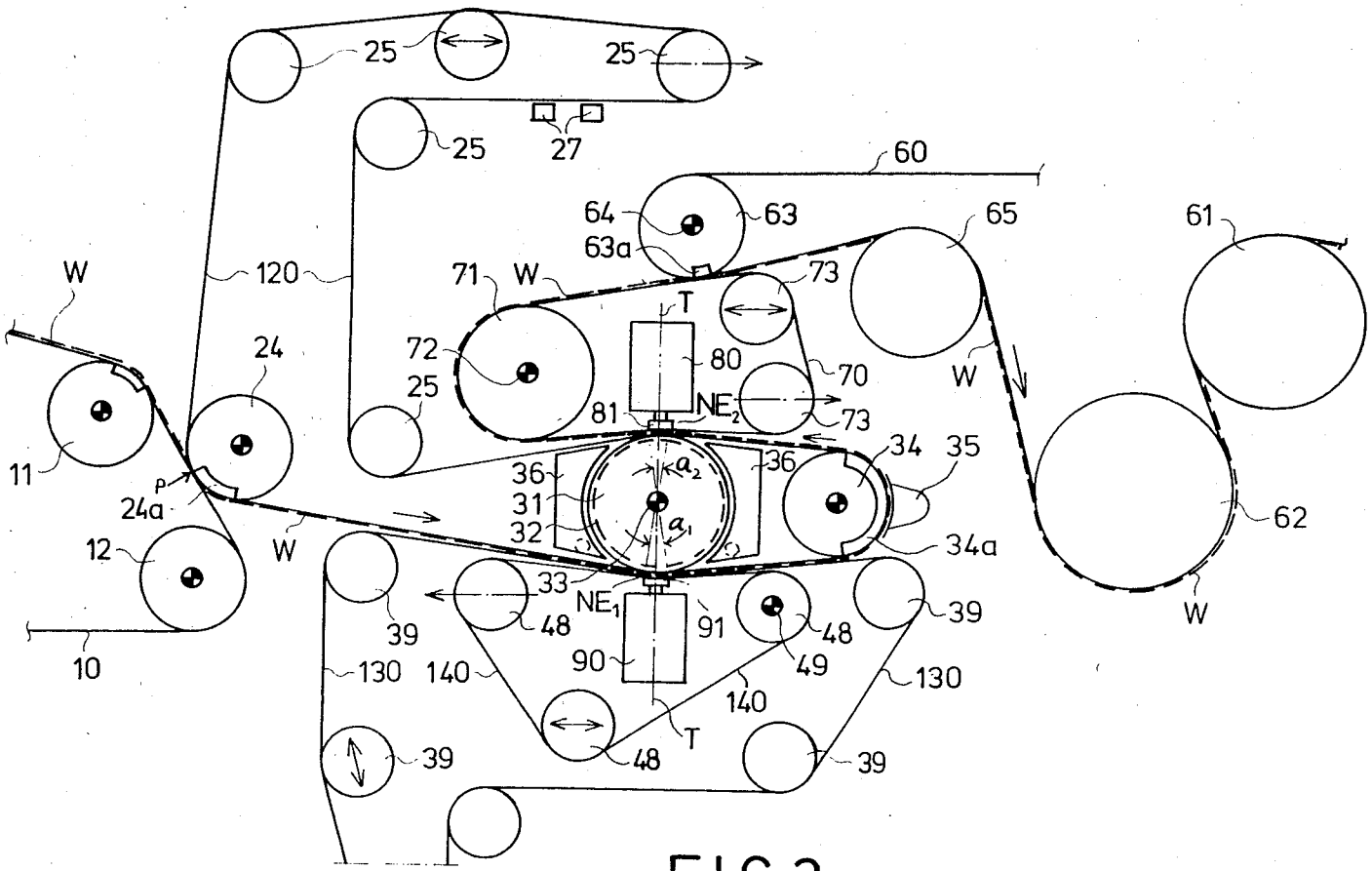
FIG. 2 is a schematic side view of another embodiment of a press section according to the present invention in which two shoe nips having wide press regions in the running direction of the web, are arranged opposite one another about a central roll.

Referring to FIGS. 1 and 2, the common structural features of a press section of the present invention of the embodiments illustrated in FIGS. 1 and 2, will be described. At the beginning of the press section, a paper web W is detached from a fabric 10 of the wire section between the rolls 11 and 12 and transferred onto a first felt 20; 120 at detaching point P within the suction zone 24*a* of pick-up roll 24. Web W adheres to the lower face of the first felt 20; 120 by means of suction zone 24*a*, with the web W being transferred into a first press nip $N_1$; $NE_1$. At the end of the press section, web W is transferred on felt 20; 120 to the drying section of a paper machine, for example onto drying fabric 60 running between lines of drying cylinders. In FIGS. 1 and 2, one drying cylinder 61 of the upper line and one drying cylinder 62 of the lower line of the drying section, are illustrated.

Referring to FIG. 1, the first nip $N_1$ is a two-felt nip, with the web W running therethrough between the first felt 20 which also comprises, the pick-up felt, and a second felt 30 which is a lower felt in nip $N_1$. The first nip $N_1$ is a roll nip formed between an upper roll 21 provided with drive means 23 and a hollow face 22, and a corresponding lower roll 31, also provided with drive means 33 and a hollow face 32. A water collecting trough 26 is disposed in connection with the upper roll 21, while a water collecting trough 36 is disposed in connection with the lower roll 31. The hollow faces 22 and 32 of the respective rolls 21 and 31, may be formed by grooves extending around the respective rolls, blind-drilled bores, or equivalent construction. The rolls 21 and 31 are preferably solid-mantle rolls, in order to be sufficiently strong to withstand high compression loads in the press nip. In this regard, rolls 21 and 31 are expressly not press-suction rolls, but are preferably solid-mantle rolls as noted above, being variable-crown rolls if necessary. The guide rolls of the upper felt 20 are denoted by reference numeral 25, with the felt reconditioning equipment for the upper felt 20 being denoted by reference numeral 27. Corresponding guide rolls of the lower felt 30 of the first press nip $N_1$ are denoted with reference numeral 37, with felt reconditioning equipment of the lower felt 30 being denoted with reference numeral 38.

After the first press nip $N_1$, in which a considerable amount of water is removed from the web W into the felts 20 and 30, the web W is transferred between the felts 20 and 30 to a reversing suction roll 34, having a suction zone 34*a* which ensures that the web W will follow along with the lower felt 30. The direction of running of the web W is substantially reversed about the reversing suction roll 34. Within the suction zone 34*a* of the suction roll 34 (such zone extending approximately 180° about the suction roll 34 in the running direction of the web W as illustrated in FIG. 1) a steam supply box 35 is disposed, through which steam is supplied within suction zone 34*a* in order to heat the fibre system of the web W and the water contained therein, so that dewatering is intensified in a subsequent nip NE.

The press section of FIG. 1 is provided with a second or subsequent nip NE in the form of a shoe nip having a wide pressing region a in the running direction of the web as illustrated in FIG. 1. The web W passes through this press nip NE between the felt 30, which is an upper felt in nip NE, and a water impervious press belt 40. The nip NE is formed between a known press shoe arrangement 43 of a long-nip press, which is provided with a press shoe 44 pressing against the belt 40, and the hollowfaced roll 31. In this second nip NE, the fibrous web W is compressed to attain its ultimate solid matter content, with regard to its pressing treatment. The surface properties of the impervious press belt 40 running through nip NE, are such that after passing through nip NE, the web W follows along with this belt 40 which in turn runs over guide rolls 45 and a reversing roll 41 provided with drive means 42. Within the region of roll 41, the web W is transferred onto a draw fabric 50, as illustrated in FIG. 1. The draw fabric 50 is guided by guide rolls 51 and 52, as well as by a suction-transfer roll 46. The web W is detached from the press belt 40 at a suction section 46*a* of roll 46 and transferred onto the draw fabric 50, which in turn transfers the web W onto the drying fabric 60 of the drying section, running over the drying cylinders 62, 61.

The structural and operational features of the embodiment of the invention disclosed in FIG. 2, to the extent that they differ from the embodiment disclosed in FIG. 1, will now be described. Referring to FIG. 2, two shoe nips $NE_1$ and $NE_2$ having wide pressing regions in the running direction of the web W, are formed in connection with a press roll 31, having a relatively large diameter and a hollow face 32, and being provided with drive means 33. The angular widths of the pressing regions of nips $NE_1$ and $NE_2$ are denoted by $a_1$ and $a_2$ respectively. The press felt 120 running over the pick-up roll 24 acts as a pick-up fabric as well as a press felt in both the first nip $NE_1$ and second nip $NE_2$.

The first nip $NE_1$ is a two-felt nip, with the lower felt therein being a press felt 130 guided by guide rolls 39 end with felt 120 being the upper felt. A press belt 140 is disposed inside the loop of the lower felt 130 as illustrated in FIG. 2, and is guided by guide rolls 48. The guide roll 48 after the first nip $NE_1$ is provided with drive means 49. The first nip $NE_1$ is formed by the roll 31 and a press shoe arrangement 90 fitted inside the loop of the press belt 140 and provided with a press shoe 91.

After the first nip $NE_1$, the web W is passed between the felts 120 and 130 onto the reversing suction roll 34, over which the web W changes its direction so that it is substantially reversed within the suction sector 34*a*. A steam supply box 35 is also disposed adjacent the suction sector 34*a*, as described with respect to the embodiment illustrated in FIG. 1. After the first or lower nip $NE_1$, while supported by the felt 120, the web W is transferred into the second nip $NE_2$ having a wide press region $a_2$ in the direction of running of the web W. A press belt 70 passes through the second upper nip $NE_2$ and is guided by guide rolls 73 and reversing roll 71 provided with drive means 72. A second press shoe arrangement 80 is disposed inside the loop of press belt 70 which is provided with a press shoe 81. The surface properties of the press belt 70 are such that after the nip $NE_2$, the web W follows along with the press belt 70 around reversing roll 71 and is detached within suction sector 63*a* of a reversing suction roll 63 provided with drive means 64, and is carried thereby and transferred onto the drying fabric 60. As illustrated in FIG. 2, the drying fabric 60 runs around roll 65 and then onto the first drying cylinder 62.

An important feature of the present invention is the mode of loading of the central roll 31 forming part of the press nips or press zones $N_1$; NE (FIG. 1) or $NE_1$; $NE_2$ (FIG. 2) in the embodiments of the present invention. Extremely high force is directed at the central roll 31, on the order of $10^7$ N when the width of a paper machine is about 10 m. Therefore, the roll 31 is necessarily extremely heavy. The weight of the roll 31 in a paper machine having a width of about 10 m, may be up to about $10^5$ kg. In the embodiment illustrated in FIG. 1, it has been possible to control the forces directed at the central roll 31, by disposing the press roll 21 and the press shoe arrangement 43, 44 at opposite sides of the roll 31, substantially in the same vertical plane T—T. Thus, in accordance with the embodiment illustrated in FIG. 1, it is now possible to take advantage of the great weight of central roll 31, as a counter-force for the compression pressure prevailing in the press nip NE within the wide press region a.

Correspondingly, in accordance with the embodiment illustrated in FIG. 2, the press shoe arrangements 90 and 80 have been disposed to form the respective press nips or zones $NE_1$ and $NE_2$, so that the respective pressing regions $a_1$ and $a_2$ are situated about the central roll 31 also in substantially the same vertical plane T—T. Of course, it is understood that in accordance with the present invention, the plane T—T need not necessarily be disposed vertically; for example, plane T—T may be inclined with respect to the vertical plane so long as the respective press nips or zones are substantially diametrically opposed to each other with respect to the central roll 31. Moreover, it is understood that in accordance with the present invention, e.g. in the embodiment illustrated in FIG. 1, upper press roll 21 in the first press nip $N_1$ may be replaced for example by two corresponding rolls disposed symmetrically relative to the plane T—T and forming two separate roll nips, one right after the other, together with the central roll 31.

In accordance with the present invention, reversing suction roll 34 can be advantageously fitted between the first and second press nips ($N_1$; NE in FIG. 1 and $NE_1$; $NE_2$ in FIG. 2). Steam supply box 35 can be advantageously disposed in connection with suction roll 34, by means of which the web W may be heated between the first and second respective press nips, as noted above.

Another important feature of the present invention is that the web W is passed in a fully closed draw from the forming fabric 10 in the preceding wire section, through the entire press section, and onto the drying fabric 60 of the subsequent drying section. Thus the risk of breakage of the web W as it is pressed through the pressing section of the present invention, is substantially reduced.

In accordance with the present invention, press belts 40 and 140 in the embodiments illustrated in FIGS. 1 and 2 respectively, also act as transfer belts carrying the web W forwardly and are formed and disposed so that these press belts 40, 140 do not substantially rewet the web W after the same passes through the respective press nips, Nips NE,$NE_1$ and $NE_2$ in the illustrated embodiments of the present invention having the wide press region a, $a_1$ and $a_2$ respectively, are formed with known press shoe arrangements that may be hydrodynamic and/or hydrostatic, or may be formed by corresponding press belt arrangements.

The preceding description of the present invention is merely exemplary, and is not intended to limit the scope thereof in any way.

What is claimed is:

1. A press section for a paper web in a paper machine which also includes a forming section and a drying section, comprising:

a central hollow-faced non-suction roll;

a first double-felted press zone defined by said central roll and first press means situated in press zone-defining relationship with said central roll;

a second wide press zone defined by said central roll and second press means situated in press-defining relationship with said central roll;

said first and second press zones being located in substantially diametrically opposed relationship with respect to said central hollow-faced press roll and substantially in the region of a vertical plane passing through the axis of said central roll;

a first press fabric passing through said first and second press zones having a run from said first press zone to said second wide press zone;

a reversing suction roll substantially horizontally spaced from said central press roll and located between said first press zone and said second wide press zone, over a sector of which said run of said first press fabric reverses;

a second press fabric passing through said first press zone; and means for conducting the web from the press section in a closed draw to the drying section; wherein a wide press zone constituted by said first or second press zones is disposed at the bottom of said central press roll.

2. The press section of claim 1, wherein said first press zone in constituted by a roll nip, and said second press zone constitutes said wide press zone at the bottom of said central press roll.

3. The press section of claim 2, wherein said second press zone comprises at least one of a belt nip, a shoe nip having a wide pressing region, or a plurality of any such nips.

4. The press section of claim 1, wherein said first press zone constitutes said wide press zone at the bottom of said central press roll.

5. The press section of claim 4, wherein said second press zone comprises at least one of a belt nip, a shoe nip having a wide pressing region, or a plurality of any such nips.

6. The press section of claim 4, additionally comprising a steam box disposed adjacent to the reversing suction sector of said suction roll to raise the temperature of the running fibrous web and of the moisture contained therein to intensify removal of the moisture from the web in said second press zone.

7. The press section of claim 4, in which said first and second press zones are both in the form of shoe nips having wide pressing regions, and additionally comprising a press belt disposed in said first press zone.

8. The press section of claim 2, additionally comprising a steam box disposed adjacent to a suction sector of said reversing suction roll to raise the temperature of the running fibrous web and of the moisture contained therein to intensify removal of the moisture from the web in said second press zone.

9. The press section of claim 2, in which said central roll is a solid mantle roll, and said first press zone comprises a second solid mantle roll, forming the roll nip with said central roll.

10. The press section of claim 2, wherein said first press zone comprises an upper hollow-faced roll, said central roll being disposed as a lower hollow-faced roll in said first press zone.

11. The combination of claim 2 wherein a substantially impervious belt passes through said second wide press zone, the web being situated in said second press zone between said first press fabric and said belt.

12. The combination of claim 2 wherein said first and second press fabrics comprise lower and upper felts in said first double-felted press zone wherein the web is situated between said first and second press fabrics.

13. The combination of claim 2 wherein said second press fabric constitutes a pick-up fabric for picking up the web from the forming section and carrying the web into said first double-felted press zone.

14. The combination of claim 4 wherein a substantially impervious belt passes through said first wide press zone wherein the web is situated between said first press fabric and said belt.

15. The combination of claim 11 wherein said means for conducting the web from the press section in a closed draw comprises a fabric for picking up the web from said belt.

16. The combination of claim 4 wherein said first and second press fabrics comprise upper and lower felts in said first double-felted press zone wherein the web is situated between said first and second press fabrics.

17. The combination of claim 4 wherein said first press fabric constitutes a pick-up fabric for picking up the web from the forming section and carrying the web into said first double-felted and second wide press zones.

18. The combination of claim 4 wherein a substantially impervious belt passes through said second wide press zone wherein the web is situated between said first press fabric and said belt.

19. The combination of claim 18 wherein said means for conducting the web from the press section in a closed draw comprises a fabric for picking up the web from said belt.

* * * * *